United States Patent [19]

Boyden, II et al.

[11] Patent Number: 4,952,147

[45] Date of Patent: Aug. 28, 1990

[54] LIME SLUDGE KILN

[75] Inventors: John W. Boyden, II, Webster; James F. Schooling, Jr., Houston, both of Tex.

[73] Assignee: Champion International Corporation, Stamford, Conn.

[21] Appl. No.: 914,482

[22] Filed: Oct. 1, 1986

[51] Int. Cl.[5] ..... F27B 7/00

[52] U.S. Cl. ..... 432/103; 432/111; 432/118; 432/119; 432/48

[58] Field of Search ..... 432/105, 103, 114, 110, 432/111, 113, 118, 119, 48

[56] References Cited

U.S. PATENT DOCUMENTS

| | | | |
|---|---|---|---|
| 609,920 | 8/1898 | Stowe | 432/119 |
| 1,898,480 | 2/1933 | Corkill | 432/110 |
| 2,319,548 | 5/1943 | Kronstad | 432/111 |
| 3,026,627 | 3/1962 | Moklebust | 432/118 |
| 3,206,526 | 9/1965 | Rygaard | 432/119 |
| 3,228,670 | 1/1966 | Moklebust | 432/118 |
| 3,366,374 | 1/1968 | Bay et al. | 432/48 |
| 3,448,969 | 6/1969 | Windsor | 432/48 |
| 3,519,254 | 7/1970 | Putman | 432/48 |
| 3,603,569 | 9/1971 | Abboud | 432/111 |
| 4,181,495 | 1/1980 | Bernt | 432/118 |
| 4,300,837 | 11/1981 | Malbrunot | 432/118 |

*Primary Examiner*—Henry C. Yuen

*Attorney, Agent, or Firm*—Evelyn M. Sommer

[57] ABSTRACT

A kiln for reclaiming quick lime from calcium carbonate sludge formed in the production of cooking liquors in a wood pulping process for the production of paper. The kiln provides increased output with lower energy input due to: measurement and control of oxygen content in the kiln; non-air mixing burner; castable refractory liner with tumbler ribs; a heat transferring chain system; and a variable speed exhaust fan and air flow control. The output of the kiln was increased by more than ten percent along with a forty-five percent improvement in energy efficiency at substantial cost reduction due to its efficient use of energy.

2 Claims, 2 Drawing Sheets

LIME SLUDGE KILN

This invention relates to a calcining kiln, and more particularly relates to a rotary kiln for converting lime sludge by-product into quick lime.

In the manufacture of paper, cooking liquors are formed on site by mixing quick lime, sodium carbonate and sodium sulfide together. A by-product of this process is lime sludge, which is a mixture of calcium carbonate, inorganic sulfur compounds, a small quantity of sodium hydroxide, and water. This lime sludge by-product is then reconverted to quick lime on site in a calcining rotary kiln.

The lime sludge is a difficult material to work with since it is a mud-like product which must be fed into the kiln, whereupon it is dried and calcined. The lime sludge also contains harmful alkali ingredients such as sodium hydroxide which will attack the refractory lining of the kiln. Reduced sulfur compounds are also found in the lime sludge, whereby gaseous emissions of these compounds must be carefully controlled. For this reason, the concentration of oxygen in the kiln must be carefully monitored and regulated.

Alkali (NaOH) attack on the castable kiln lining is a function of both the concentration of alkali in the feed material and the temperature range in the kiln. Obviously, as the concentration of alkali in the feed material is increased, alkali attack on the castable is increased, since there is more alkali available to attack the castable. The control of alkali concentration is accomplished outside of the kiln in a lime mud washer which reduces the alkali concentration by dilution with water to a 20% solids mixture, and on a lime sludge filter, which unit reduces the alkali concentration by dilution again and then by removal of 75 to 80% of the alkali by vacuum filtration.

The temperature range in the kiln affects the alkali attack significantly. As temperature is increased, the alkali becomes more aggressive in the attack on the castable. If temperatures remain below the level where advanced attack begins (typically 2000° F.), minimum alkali attack will be experienced.

The kiln of this invention is designed to provide increased capacity at lower energy costs while effectively dealing with the various problems noted above which are associated with the calcining of lime sludge. The kiln is provided with an oxygen analyzer of the type described in copending application Ser. No. 628,632, filed July 6, 1984. The analyzer is positioned at the inlet end of the kiln. The inlet end of the kiln is fitted with a sealed shroud through which the analyzer extends, and through which the lime sludge is fed continuously into the rotating shell of the kiln.

The emission gases produced from the kiln:
carbon dioxide ($CO_2$),
water vapor ($H_2O$),
carbon monoxide (CO), and
reduced sulfur compounds (T.R.S.)
are drawn out the shell of the kiln and through the shroud by a variable speed fan mounted in an exhaust vent communicating with the shroud and the interior of the shell. The fan also induces a flow of air into the shell through the joint between the firing hood and shell. The gas analyzer provides the kiln operator with an indication of the desired speed at which the fan should be operated. The operator thus will vary the fan speed accordingly.

Emissions from a lime kiln and energy usage in relationship to oxygen control are related in an inverse manner. Oxygen is necessary for the combustion of fuel (natural gas in this case) in a specific quantity or theoretical amount which is a calculated value. Any amount of oxygen used in excess of the calculated theoretical value reduces the energy efficiency. If the amount of oxygen is below the calculated theoretical value, all of the fuel will not be combusted and the energy efficiency will be reduced. The control of emissions also influences the amount of oxygen required to operate the kiln. The emission from the kiln which is regulated by the Environmental Agencies for lime kilns is Total Reduced Sulfur (TRS). To minimize TRS emissions, a sufficient amount of excess oxygen must be present in the kiln after all the fuel has been combusted to oxidize the TRS compounds—oxidized TRS compounds are not regulated for lime kilns, since they are non-odorous and present little detriment to the environment.

If enough excess oxygen is not present, the TRS compounds will not be completely oxidized and TRS emissions will not be in compliance with the guidelines of the regulatory agencies.

To summarize this in simple terms:

A. High excess $O_2$ content equals lower energy efficiency which increases costs, but, the TRS emissions are minimized.

B. Low excess $O_2$ content equals improved energy efficiency, but, the TRS emissions are not minimized.

Oxygen control is very critical and the equipment used i.e , fan, variable speed motor, etc., must be very precise to maintain the maximum energy efficiency and minimum TRS emissions.

Disposed in the inlet throat of the shell, there is a suspended chain system which distributes heat evenly through the sludge as the latter passes through the chain system, provides a dust screen for catching suspended dust particles, and serves to break up any sludge cake lumps.

Subsequent to the chain system, the interior of the shell is provided with a plurality of circumferentially spaced longitudinally extending tumbling ribs which are disposed on the interior of the shell and which extend down to the discharge end of the shell. The portions of the interior of the shell which lie between the tumbling ribs are faced with a castable refractory. At the discharge end of the kiln, there is a firing hood which surrounds that end of the shell. The burner is mounted in the firing hood so as to project a flame into the shell toward the chain system. An exit chute communicates with the firing hood to provide for the discharge of the calcined product from the exit end of the shell.

The kiln is able to minimize alkali attack on the castable by being able to operate at or below the above mentioned 2000° F. temperature. Without the improvements described herein, normal operating temperatures for this kiln would be in the range of 2200°-2400° F. These improvements increase the energy efficiency of the kiln by operating with less excess air input to the kiln (improved burner and control of oxygen content), reducing heat loss through the kiln shell (castable refractory is a better insulator than brick), and reducing heat loss out of the exhaust of the kiln (chain system captures more heat from gases and transmits this heat to the sludge load). The addition of the tumblers in the kiln is a significant contributor to the ability to operate at lower kiln temperatures. To calcine calcium carbonate (lime sludge) to calcium oxide (quick lime), it requires a temperature of approximately 1500° F. Due to the relatively short retention time in a kiln (approx. 2 hours), and the poor heat transfer of the gas stream to the lime bed, the normal operating temperatures of the lime bed in a kiln are 2100°-2400° F. The tumblers serve the function of mixing or agitating the lime bed in the kiln in such a manner that the lime bed is exposed more evenly to the gas stream and the heat transfer rate is greatly improved; thus, it takes less temperature (in the range of 1800°-2000° F.) to calcine the lime sludge and still maintain the desired calcining efficiency of ninety percent (determined by the amount of calcium carbonate converted to calcium oxide). While the alkali dilution of the kiln feed occurs outside of the kiln and the kiln improvements that are disclosed herein, it must be noted that control of alkali concentration and the associated lime sludge washing and lime sludge filtering equipment should be maintained to minimize introduction of alkali compounds into the kiln for optimum performance of the method of this invention.

The kiln thus operates with minimal controlled oxygen in the range of 1 to 2%, has the improved insulating capability of the castable refractory lining, thereby requiring less energy input to achieve and maintain the internal operating temperatures which are necessary for the calcining operation. The emission of reduced sulfur is also carefully controlled by the exhaust fan. Heat is quickly and evenly spread through the lime sludge by the chain system. This precise control of operating parameters allows the use of the castable refractory lining, which is longer wearing and has better insulating qualities than refractory brick, but which is more susceptible to alkali attack than refractory brick.

It is, therefore, an object of this invention to provide an improved kiln for calcining lime sludge.

It is a further object to provide a kiln of the character described which has increased processing capacity at lower energy usage levels.

It is yet another object of this invention to provide a kiln of the character described which includes a durable cast refractory liner having increased insulation capabilities while protecting the liner from attack by the alkali constituents of the lime sludge.

These and other objects and advantages of the invention will be more readily apparent from the following detailed description of a preferred embodiment thereof when taken in conjunction with the accompanying drawings in which.

Figure 1:
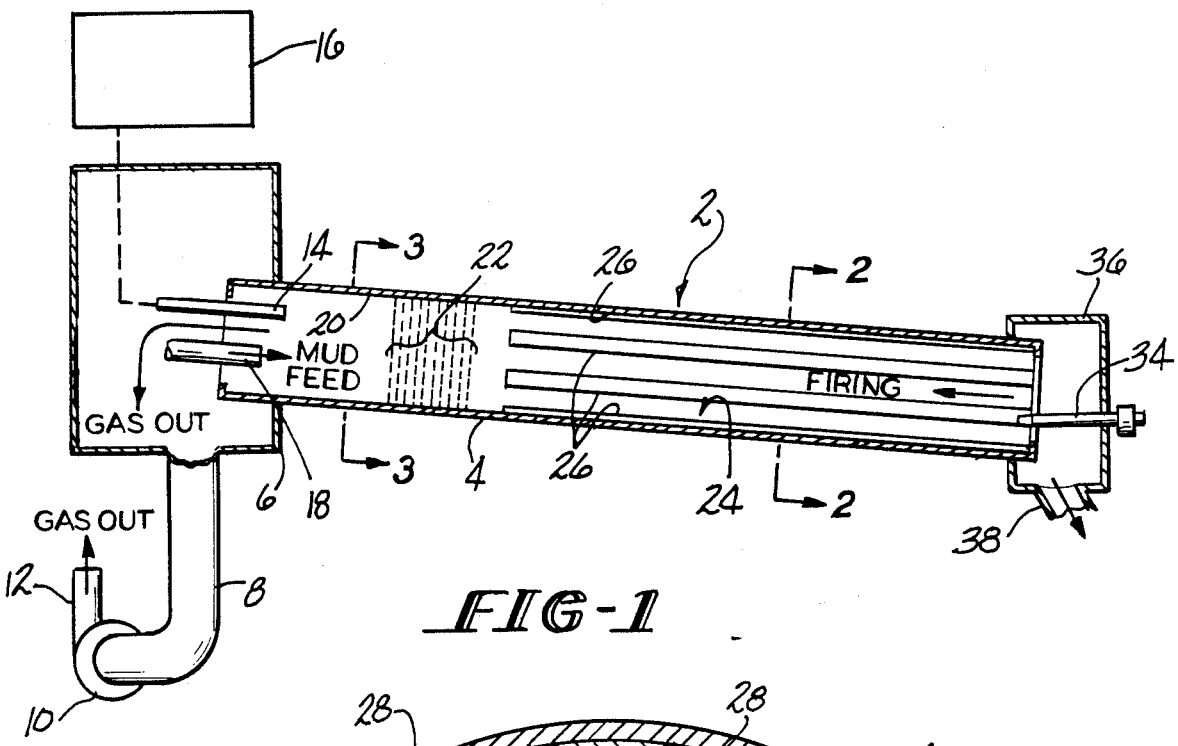
FIG. 1 is a somewhat schematic axial sectional view of a preferred embodiment of the kiln of this invention.

Referring now to the drawings, there is shown in FIG. 1 a preferred embodiment of the lime sludge kiln of this invention, denoted generally by the numeral 2. The kiln 2 includes a cylindrical shell 4 made of steel. The shell 4 is mounted in an inclined manner and is rotated about its axis by a standard rotational drive (not shown). At the upper inlet end of the shell 4, there is disposed a shroud 6 which sealingly engages the shell 4 as the latter rotates. A gas withdrawal passage 8 communicates with the shroud 6 and has an induced draft fan 10 disposed therein in communication with a stack 12. The fan draws effluent gases out of the shroud 6 and shell 4 and into the stack 12, and also draws ambient air into the firing hood 36 and shell 4 through the joint between the shell 4 and hood 36. The fan 10 is a variable speed fan so as to control the amount of air drawn into the kiln thereby controlling the amount of oxygen in the kiln. When there is too much oxygen in the kiln, its operation is inefficient, and when there is too little oxygen in the kiln, an explosion risk is created and increased reduced sulfur emissions. The percent of oxygen in the kiln is preferably maintained in the range of about 1.0% to about 2.0%. An oxygen analyzer probe 14 is mounted in the kiln and is electrically connected to control 16. The oxygen analyzer system is similar to that shown in copending application Ser. No. 628,632, filed July 6, 1984. The analyzer provides continuous monitoring of oxygen in the kiln with readout of the values being shown at the kiln operator's control panel on a ink pen recorder. The analyzer is calibrated automatically several times per day and is periodically purged of accumulated dust to ensure accurate sample reception. Adjacent to the probe 14 is a material feed inlet &8 which utilizes a screw feed to maintain a flow of the lime sludge into the kiln 2. The entry throat 20 of the kiln shell 4 is lined with a castable refractory material such as a castable refractory sold by Kaiser Refractories Co. under the brandname HI-STRENGTH COARSE 25-LI.

Figure 3:
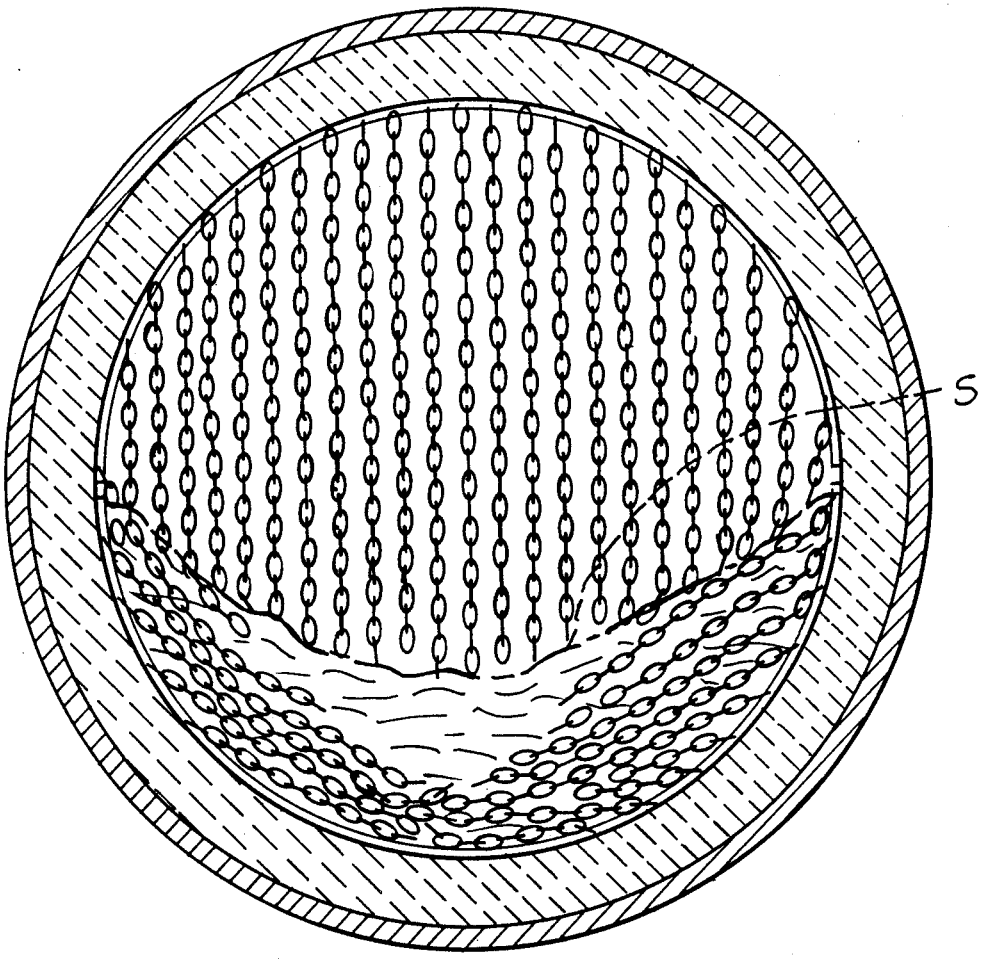
FIG. 3 is a cross-sectional view of the kiln taken along line 3—3 of FIG. 1.

Adjacent to the throat portion 20 of the shell 4, there is positioned a chain system 22. The chain system includes four serial zones, the first of which (from the feed direction) is a dust curtain composed of a relatively large number of strands of a relatively lightweight chain. This zone retards the passage of kiln dust from the downstream end of the shell 4 toward the stack 12. The second zone has a similar number of chain strands of a heavier chain which performs a granulation function. The second zone breaks up the lime sludge into small granules or lumps as the material begins to dry and move down through the shell 4 toward the discharge end. The next zone has a smaller number of relatively heavy strands which performs a pre-heating function. This zone spreads the heat from the burner throughout the lime sludge as it descends through the shell so as to speed drying of the wet material. It should be noted that the incoming material will conventionally contain 30-35% of water. The last chain zone has a larger number of strands of the heaviest chain in the chain system and forms a radiant shield. The purpose of the radiant shield is to retain substantial heat in the next adjacent tumbling zone 24 of the kiln. These chains are all fastened to the shell in one position and the other end of the strand is allowed to hang free, as shown in FIG. 3. The chains will be suspended in the gas stream when the hanger is at the apex of the kiln rotation and then will be contacting the sludge bed S (shown in phantom) as the kiln rotates to the downward position to transfer heat to the sludge bed. The specific chain system uses chain strands and mounts manufactured by Thermacon, Inc. of Dunedin, Fla.

Referring back to FIG. 1, the tumbling zone 24 includes a plurality of axially extending tumblers 26 mounted on and projecting inwardly from the wall of the shell 4. The portions between the tumblers 26 are formed with the castable refractory noted above. The tumblers 26 are formed from a plurality of precast bricks or ingots made from the castable refractory material. The individual tumblers are aligned in the shell 4 and welded to the inner surface of the shell.

Figure 2:
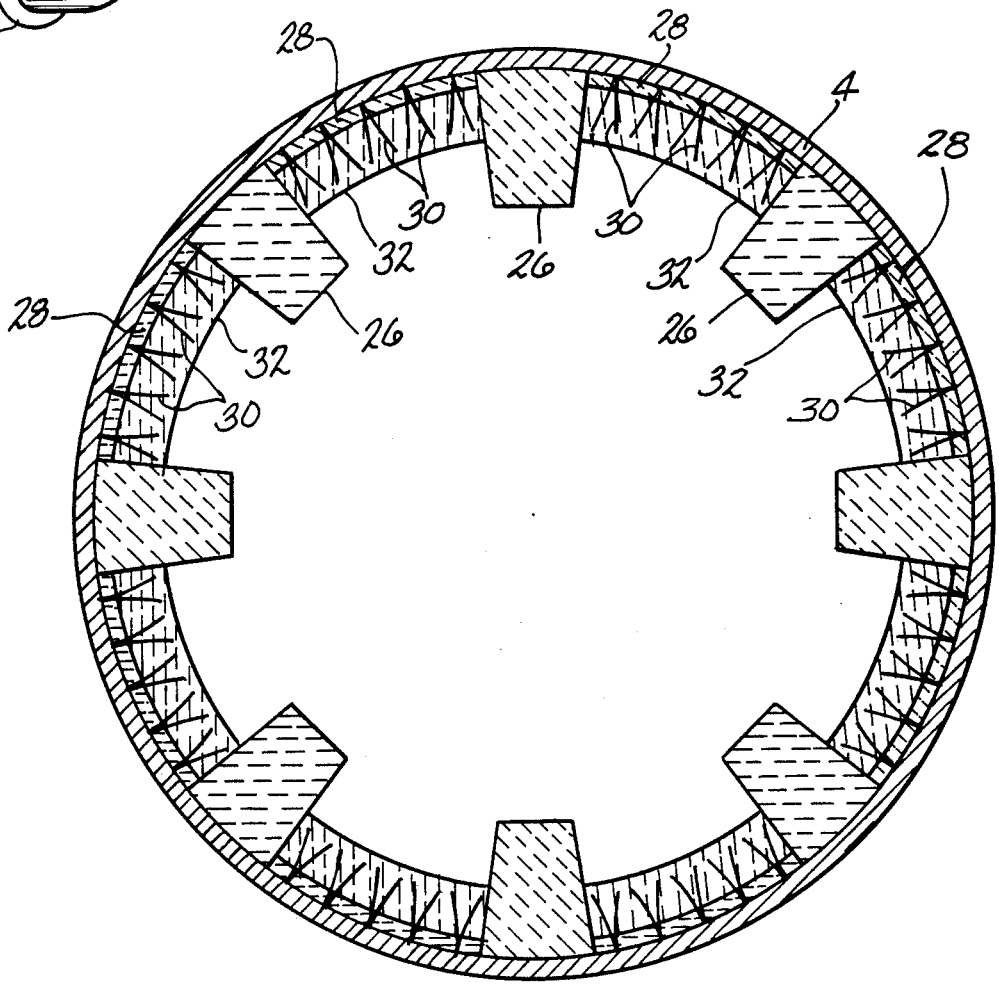
FIG. 2 is a cross-sectional view of the kiln taken along line 2—2 of FIG. 1.

FIG. 2 shows the manner in which the tumbling zone 24 is formed. As previously noted, the tumblers 26 are welded directly to the shell 4. Between the tumblers, a plurality of Fiberfax Duraboard sheets 28 are secured to the shell 4 by an adhesive such as sodium silicate. Fiberfax Duraboard is a synthetic ceramic fiber formed into a sheet of various sizes and thicknesses. It is used as an insulation board placed between the kiln shell and the castable refractory layer to provide additional insulating value and contain more heat inside the kiln. The sheets 28 have a regular pattern of holes pre-drilled in them, and anchors 30 are welded in the holes directly to the shell 4. The anchors 30 project beyond the exposed surfaces of the sheets 28. The castable refractory layer 32 is then cast onto the sheets 28, one segment at a time, with the anchors 30 forming a securement for the layer 32. The castable refractory material used in the tumbling zone is preferably Kaiser HI-STRENGTH COARSE 25-LI Refractory.

A kiln hood 36 covers the lower outlet end of the shell 4 and engages the shell 4 as the latter rotates. A discharge chute 38 opens downwardly from the hood 36 to provide a path of egress for the calcined product, which has a dry particulate form. Extending through the hood 36 is the burner 34, which is a long flame, low oxygen burner, preferably a CP-VO gas kiln burner gun, manufactured by Voorheis Industries, Inc. of Fairfield, N.J. The gas burner is regulated by the amount of gas flow introduced to the burner. This flow is regulated manually by the operator to maintain the specified temperature range in the lime bed in the kiln (1800°-2000° F.).

Temperature measurement is accomplished by using a Honeywell optical pyrometer which is mounted on the kiln hood. This instrument is used to measure the temperature of the lime bed inside the kiln. The temperature is maintained within the guidelines by necessary adjustments to the gas flow to the gas burner. The burner flame extends in a long narrow form with very little mushrooming in over the product as it passes down through the tumbling zone 24.

The operating temperature of the lime bed in the kiln at the product end is 1800°-2000° F. Typical temperature range in the emission gas to the ID fan is 275°-325° F.

The subject kiln has proven to be highly energy efficient and has increased capacity which has eliminated the production bottleneck typically found in a paper mill at the lime sludge kiln.

Since many changes and variations of the disclosed embodiment of the invention may be made without departing from the inventive concept, it is not intended to limit the invention otherwise than as required by the appended claims.

What is claimed is:

1. A lime sludge calcining kiln comprising:

(a) a rotatable shell having an inlet end and a discharge end in a downstream direction from said inlet end;

(b) a castable refractory layer forming the innermost surface in said shell, said refractory layer extending from said inlet end to said discharge end;

(c) a chain system in said shell downstream of said inlet end, said chain system comprising a plurality of chains suspended from one end only in said shell, said chains being operable to form a heat retaining curtain in said shell, to intimately contact lime sludge passing through said shell to transfer heat to the lime sludge, and to comminute chunks of the lime sludge;

(d) a plurality of tumbling ribs formed from precast bricks of a castable refractory material and disposed in said shell between said chain system and said discharge end of the shell, said tumbling ribs being circumferentially spaced apart from each other and elongated axially of said shell, and said tumbling ribs projecting inwardly beyond said castable refractory layer to form means for tumbling the lime sludge as the latter passes through said shell as the shell rotates;

(e) a single burner at said discharge end of said shell, said burner being operable to project an elongated flame over said tumbling ribs and toward said chain system;

(f) an oxygen measuring probe disposed in said inlet end of said shell upstream of said chain system and operable to measure the percent of oxygen present in said inlet end of said shell;

(g) an emission stack operably connected to said inlet end of said shell for venting combustion gases from said shell to the atmosphere; and (h) a variable speed fan positioned between said inlet end of said shell and said emission stack to draw combustion gases from said shell into said emission stack, and also to provide a controlled drawing of oxygen into said shell at said discharge end thereof, based on the measurement of oxygen by said oxygen measuring probe.

2. The kiln of claim 1, wherein there is a layer of a synthetic ceramic fiber insulation board interposed between said shell and said castable refractory layer at least downstream of said chain system.

* * * * *